US006334612B1

(12) United States Patent
Wurz et al.

(10) Patent No.: US 6,334,612 B1
(45) Date of Patent: Jan. 1, 2002

(54) ERGONOMICALLY-DESIGNED GAMING MACHINE

(75) Inventors: Norman R. Wurz, Des. Plaines; James M. Rasmussen, Chicago; William C. Cesaroni, Glenview; Robert J. Glenn, II, Rolling Meadows; Jack B. Hough, Chicago, all of IL (US)

(73) Assignee: WMS Gaming Inc., Chicago, IL (US)

( * ) Notice: Subject to any disclaimer, the term of this patent is extended or adjusted under 35 U.S.C. 154(b) by 0 days.

(21) Appl. No.: 09/441,125

(22) Filed: Nov. 17, 1999

(51) Int. Cl.[7] ..... A63B 71/00
(52) U.S. Cl. ..... 273/143 R; 463/20; 463/46
(58) Field of Search ..... 463/46, 20, 12, 463/13, 18, 19; 273/143 R

(56) References Cited

U.S. PATENT DOCUMENTS 5,413,357 A * 5/1995 Schulze et al. ..... 273/436
5,951,397 A 9/1999 Dickinson

OTHER PUBLICATIONS

Internet web site; "Ergonomics and Workstation Design," *Distributed Systems Technology*, Oct. 19, 1995, 3 pgs.
Internet web site; "Ergonomics Guidelines," *The General Libraries,* Oct. 23, 1995, 10 pgs.
Charts; "Humanscale Body Measurements," designed by Henry Dreyfuss Associates (1981), 12 pgs.
Book; *Humanscale 1/2/3*; (1994), 36 pgs.
Book; *Humanscale 4/5/6*; (1981); 51 pgs.
Book; *Humanscale 7/8/9*; (1981); 55 pgs.

* cited by examiner

*Primary Examiner*—Benjamin H. Layno
(74) *Attorney, Agent, or Firm*—Jenkens & Gilchrist

(57) ABSTRACT

An upright gaming machine comprises a housing, a mechanical or video display, a controller, a button panel, a player interface, and a coin tray. The display is mounted to the housing and is tilted slightly back at its top from an average seated player. The controller is disposed within the housing. In response to the player selecting a wager using the button panel, the controller is adapted to play a game of chance and randomly generate a game outcome on the display and provide a payout if the game outcome matches predetermined criteria. The coin tray may be used to dispense the payout. The player interface section, which includes a card reader for tracking players who insert their cards therein, is arranged on the housing between the display and the button panel. Various features of the gaming machine are ergonomically designed to minimize physical discomfort that may accompany prolonged static postures and repetitive motions of an average seated player playing the machine. Such features may include, for example, the height and angle of the button panel; the horizontal position of the button panel relative to the coin tray; the height and angle of the display; and the height of the player interface section.

16 Claims, 3 Drawing Sheets

ERGONOMICALLY-DESIGNED GAMING MACHINE

FIELD OF THE INVENTION

The present invention relates generally to gaming machines and, more particularly, relates to an ergonomically-designed "upright" gaming machine adapted to be played by a player in a seated position instead of a standing position.

BACKGROUND OF THE INVENTION

Ergonomics is a body of knowledge about human abilities, human limitations and other human characteristics that are relevant to design. Ergonomic design is the application of this body of knowledge to the design of tools, machines, systems, tasks, jobs, and environments for safe, comfortable and effective human use. The word "ergonomics" is often used synonymously with "human factors engineering."

Many people view ergonomics as the science and applied science of fitting tasks and equipment to people, rather than forcing people to adapt to designs that neglect the unique capabilities and limitations of the human. Designs that consider human abilities often make human work more productive, efficient, reliable, and safe. These factors often translate into significant bottom-line competitive strategies for the companies that choose to implement ergonomic principles into the design and operation of their products.

The method in which a product is used defines whether that particular product is ergonomically designed. Thus, when designing a product one should have a particular use in mind before one can determine what design of the product will be the best "fit." Determining the "fit" requires consideration of tasks to be performed with the product, including such things as the population of people that will interact with the product, and the physical and cognitive abilities required by the product and tasks. Therefore, a product may be ergonomically designed for a specific application by designing the product to match the characteristics of the required operations and the characteristics of the people that will be using the product.

Some products are designed to specifically reduce one or more commonly understood ergonomic risk factors. Ergonomic risk factors include such things as high forces, awkward postures, repetition, vibration, etc. For example, a tool that has been designed to reduce potentially harmful exposure to hand/arm vibration could be considered "ergonomically designed," but only in terms of its vibration characteristics. If a worker is required to use that same tool in a stressful posture, due to a mismatch between the tool, worker, and the orientation of the point of tool operation, for instance, then that tool may no longer be considered "ergonomic" for that particular application.

Heretofore, gaming machines such as slot machines and video lottery terminals have been designed in two distinct styles: a "slant-top" style and an "upright" style. "Slant-top" gaming machines include a mechanical or video display that is slanted at about a thirty degree angle toward a player and are designed to be played by a player in a seated position. Although the "slant-top" machines are fairly comfortable to use by a player in a seated position, the machines occupy a lot of valuable floor space in establishments such as casinos.

"Upright" gaming machines include a mechanical or video display that is oriented substantially vertical relative to a player and are designed to be played by a player in a standing position. Although the "upright" machines occupy less floor space than the "slant-top" machines, the "upright" machines are less comfortable to use than the "slant-top" machines because a player may be required to stand while playing the machine. In an effort to minimize discomfort, most establishments now provide stools for players to sit on while playing the "upright" machines.

Because the "upright" machines were originally designed to be played by a player in a standing position, a seated player often experiences discomfort while interacting with such features as the machine's button panel, card reader, and coin tray. First, the button panel is mounted at a height that requires an average seated player to awkwardly lift his or her forearms upwardly relative to the horizontal. Second, the card reader is typically mounted near the top of the machine above the machine's display. Players often carry their card on a string that hangs around their neck and leave the string around their neck even when the card has been inserted into the card reader. As a result, the string may awkwardly dangle over the machine's display as the player plays the gaming machine. Finally, the coin tray mounted below the button panel is typically located closer to a seated player than a front end of the button panel. Because this arrangement creates inadequate knee clearance, the player may bump his or her knee into the coin tray while attempting to interact with the button panel. The discomfort associated with the above-noted features of "upright" gaming machines is exacerbated by the fact that many players remain at the same machine and perform repetitious movements for long periods of time.

SUMMARY OF THE INVENTION

Accordingly, an object of the present invention is to provide an ergonomically-designed "upright" gaming machine adapted to be played by a player in a seated position instead of a standing position.

These and other objects are realized by providing an upright gaming machine comprising a housing, a mechanical or video display, a controller, a button panel, a player interface, and a coin tray. The display is mounted to the housing and is tilted slightly back at its top from an average seated player. The controller is disposed within the housing. In response to the player selecting a wager using the button panel, the controller is adapted to play a game of chance and randomly generate a game outcome on the display and provide a payout if the game outcome matches predetermined criteria. The coin tray may be used to dispense the payout. The player interface section, which includes a card reader for tracking players who insert their cards therein, is arranged on the housing between the display and the button panel. Various features of the gaming machine are ergonomically designed to minimize physical discomfort that may accompany prolonged static postures and repetitive motions of an average seated player playing the machine. Such features may include, for example, the height and angle of the button panel; the horizontal position of the button panel relative to the coin tray; the height and angle of the display; and the height of the player interface section.

The above summary of the present invention is not intended to represent each embodiment, or every aspect of the present invention. This is the purpose of the figures and detailed description which follow.

BRIEF DESCRIPTION OF THE DRAWINGS

Other objects and advantages of the invention will become apparent upon reading the following detailed description and upon reference to the drawings in which.

Figure 1:
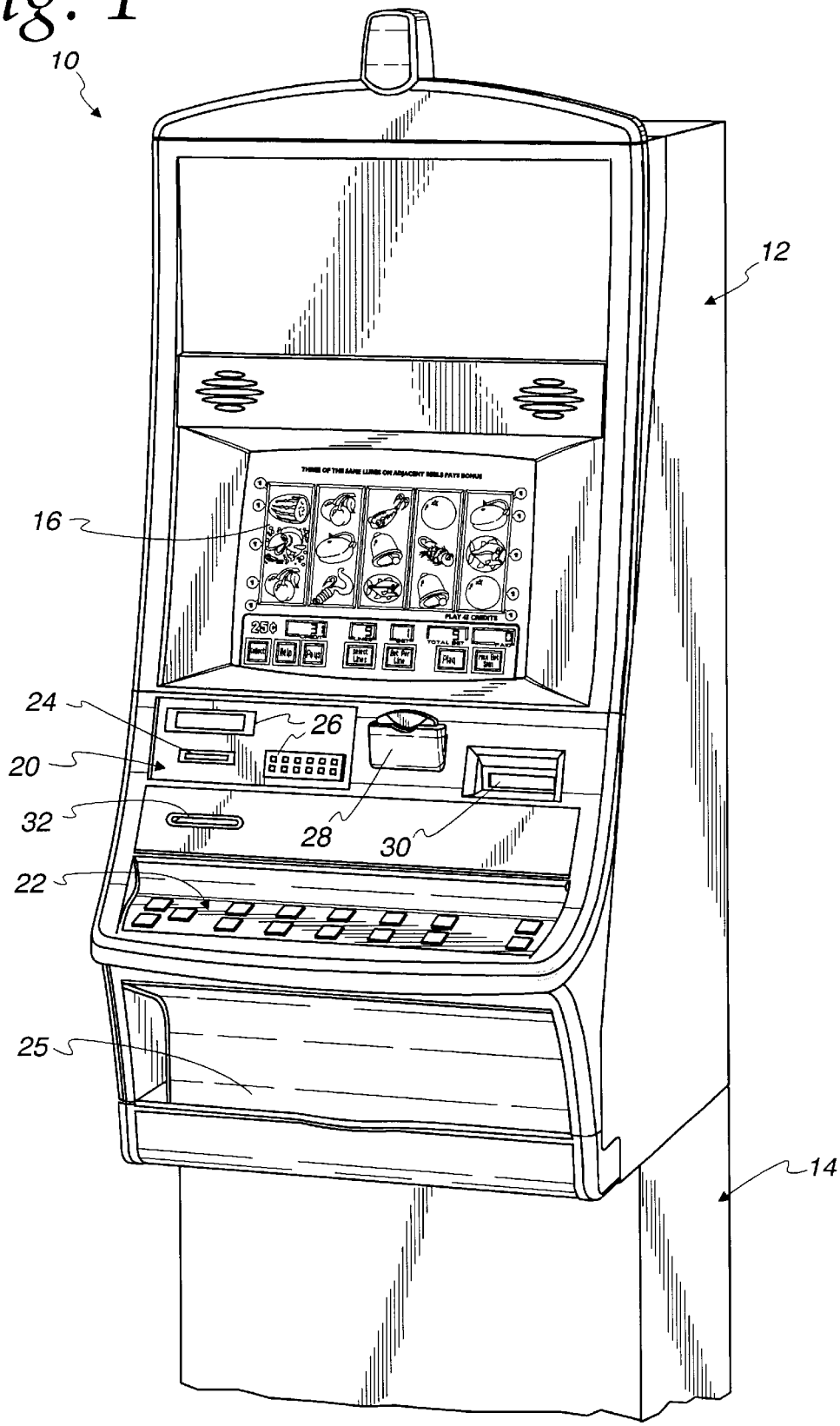
FIG. 1 is a perspective view of a gaming machine embodying the present invention.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE PREFERRED EMBODIMENTS

Figure 2:
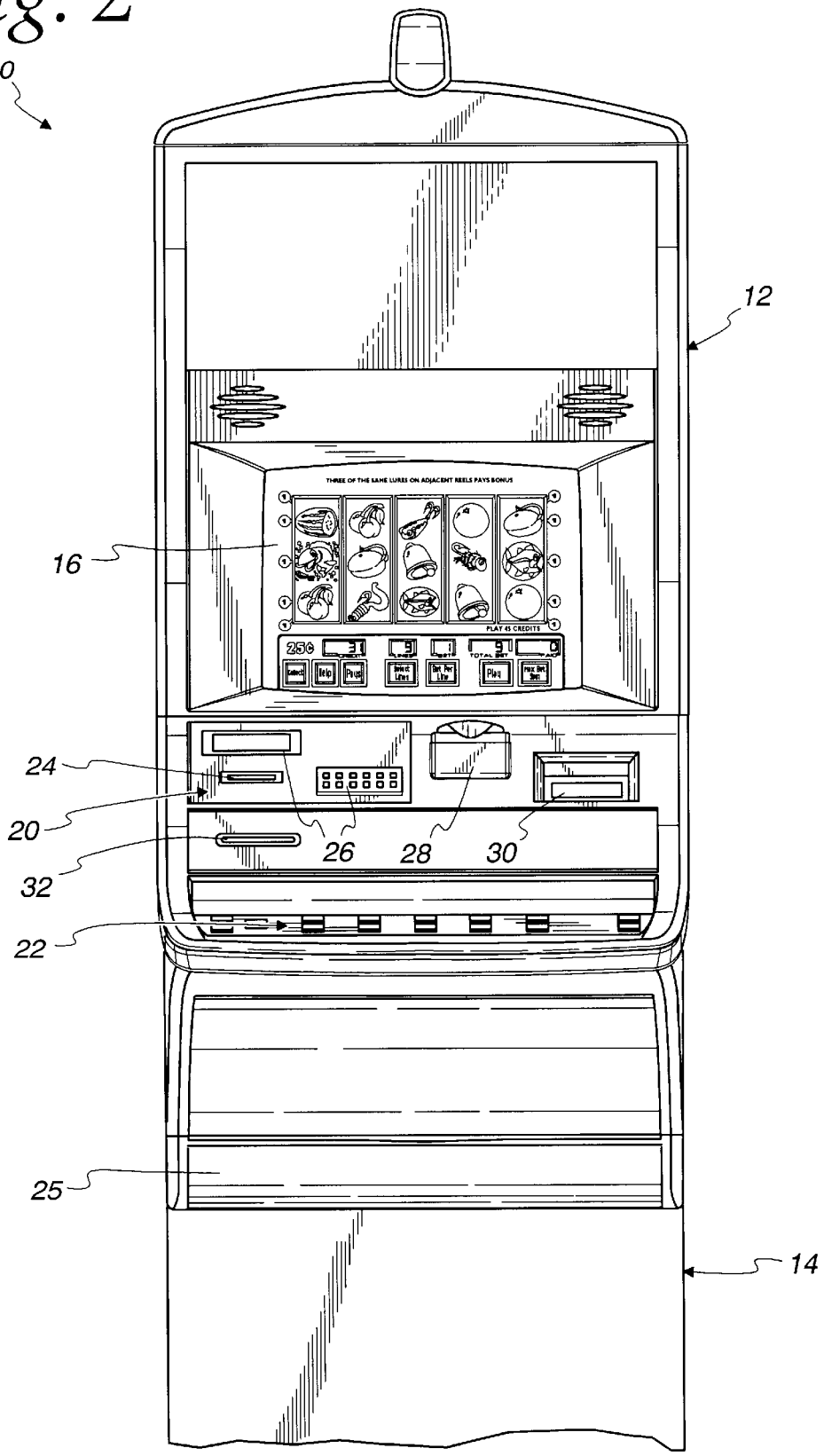
FIG. 2 is a front view of the gaming machine.

Turning now to the drawings, FIGS. 1 and 2 depict an ergonomically-designed "upright" gaming machine 10 adapted to be played by an average player in a seated position instead of a standing position. The machine 10 includes a primary housing 12 supported by a secondary housing or stand 14. The machine 10 further includes a visual or mechanical display 16, a controller 18, a player interface section 20, a mechanical button panel 22, and a coin tray 25.

The display 16 is mounted to an upper portion of the housing 12. If the display 16 is of the visual type, the display 16 may be a cathode ray tube (CRT), dot matrix, LED, LCD, electro-luminescent, or other visual display known in the art. A touch screen optionally overlays the visual display. If the display 16 is of the mechanical type, the display 16 may be a window with mechanical gaming components such as physical slot reels visible therethrough.

The controller 18 is disposed within the upper portion of the housing 12 and includes a processor that executes a game program using a random number generator. In response to executing the game program, the controller plays a game of chance and randomly generates a game outcome on the display 16. The game may involve spinning slot reels, cards (poker, blackjack, gin, etc.), keno, bingo, roulette, or any other game of chance that can be implemented on a gaming machine.

The player interface section 20 is arranged on the housing 12 immediately below the display 16 and between the display 16 and the button panel 22. The player interface section 20 includes such features as a card reader 24, a keypad and minidisplay 26, a coin acceptor 28, a bill acceptor 30, and a bill/ticket dispenser 32. Because the card reader 24 is below the display 16, instead of above the display 16 as in conventional "upright" machines, an average seated player can readily access the card reader 24 and insert his or her card into the card reader 24. If the player carries his or her card on a string and decides to leave the string around his or her neck even when the card has been inserted into the card reader 24, the string will not awkwardly dangle over the display 16 as can happen in conventional machines. By inserting his or her card into the card reader 24, the player logs into a casino's computer network. This allows the casino to track the player's gambling activities and award points and/or special awards to the player based on his or her degree of gambling.

The keypad and mini-display 26 are used by service personnel to perform diagnostics on the gaming machine 10. The display 26 is also used a billboard for advertising, announcing special awards, providing information to a player logged into the casino's computer network via the card reader, etc.

The coin and bill acceptors 28 and 30 are used to accept wagers placed by a player. If the player already has sufficient credits stored in the controller's memory, the player can also place a wager by causing the controller to deduct the wager from the stored credits. In response to a player placing the wager and the controller generating a winning game outcome on the display, the controller adds a payout corresponding to the winning outcome to the credits stored in the controller's memory. The player can collect the amount of accumulated credits via the coin tray 25 or the bill/ticket dispenser 32. The coin tray is mounted to the housing 12 below a level of the button panel 22.

The button panel 22 is mounted to the housing 12 below the player interface section 20. The button panel 22 includes numerous mechanical buttons that, in response to being pressed by a player, cause the controller 18 to perform various game functions. Some of these functions are described below in the context of a gaming machine 10 that plays a game of slots.

If the gaming machine plays slots, the controller 18 executes a game program which causes the display 16 to show video images of symbol-bearing reels in visual association with one or more pay lines. A player initiates game play by inserting a number of coins or playing a number of credits, causing the controller 18 to activate a number of pay lines corresponding to the number of coins or credits played. In one embodiment, the player selects the number of pay lines to play by pressing a "Select Lines" button. The player then chooses the number of coins or credits to bet on the selected pay lines by pressing a "Bet Per Line" button.

After activation of the pay lines, the symbol-bearing reels may be set in motion by pressing a "Spin Reels" button or, if the player wishes to bet the maximum amount per line, by pressing a "Max Bet Spin" button. Alternatively, other mechanisms such as, for example, a lever or push button may be used to set the reels in motion. The controller 18 uses a random number generator to select a game outcome corresponding to a particular set of reel "stop positions." The controller 18 then causes each of the rotating video reels to stop at the appropriate stop positions. Video symbols are displayed on the reels to graphically illustrate the reel stop positions and indicate whether the stop positions of the reels represent a winning game outcome. Winning game outcomes (e.g., symbol combinations resulting in payment of coins or credits) are identifiable to the player by a pay table. In one embodiment, the pay table is affixed to the machine 10 and/or displayed by the video display 16 in response to a command by the player (e.g., by pressing a "Pay Table" button). A winning game outcome occurs when the symbols appearing on the reels along an active pay line correspond to one of the winning combinations on the pay table. If the displayed symbols stop in a winning combination, the game credits the player an amount corresponding to the award in the pay table for that combination multiplied by the amount of credits bet on the winning pay line. The player may collect the amount of accumulated credits by pressing a "Collect" button.

In one embodiment, certain of the game outcomes cause the controller 18 to enter a bonus mode causing the video display 16 to show a bonus game. Also, if a touch screen overlays the display 16, most or all of the buttons on the button panel 22 may be duplicated on the display 16 so a player can actuate a game function via either the button panel 22 or the display 16.

Figure 3:
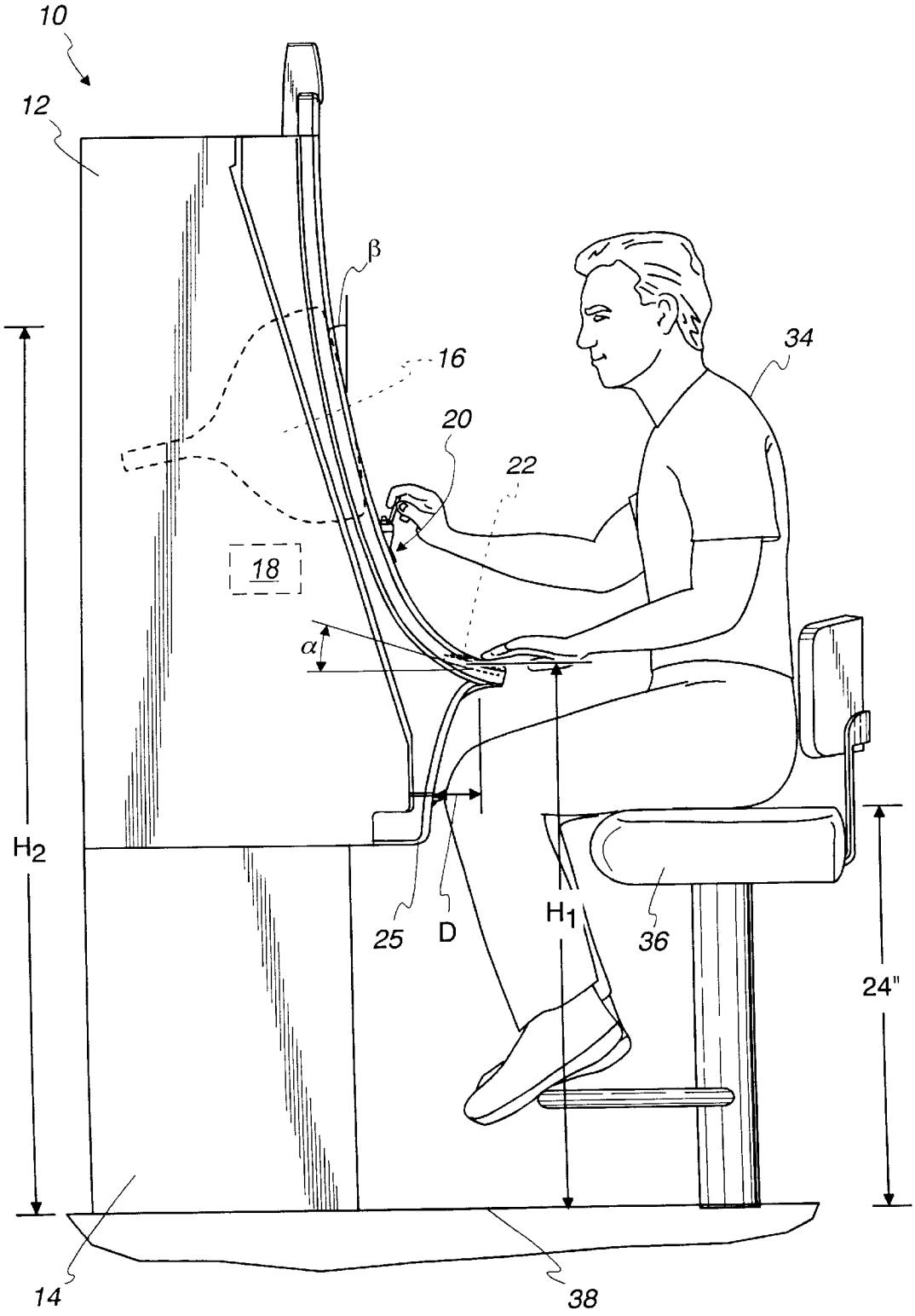
FIG. 3 is a side view of the gaming machine being played by an average player in a seated position.

Referring to FIG. 3, the "upright" gaming machine 10 is adapted to the capabilities and limitations of an average adult player 34 in a seated position instead of a standing position. By tailoring the machine 10 to an adult player 34 of average height and build, most of the population can interact with the machine 10 at close to a peak comfort level. An average adult player has a height of about 5 feet 6 inches tall. This height can be obtained by finding the average between (1) a 97.5 percentile man who is 6 feet 2 inches tall and (2) a 2.5 percentile woman who is 4 feet 10.5 inches tall.

Most establishments such as casinos provide a stool 36 having a seat disposed at a height of approximately 24 inches above the floor 38. The following features of the gaming machine 10 are ergonomically designed to minimize physical discomfort that may accompany prolonged static postures and repetitive motions of an average player 34 sitting on the stool 36: the height and angle of the button panel 22; the horizontal position of the button panel 22 relative to the coin tray 25; the height and angle of the display 16; and the height of the player interface section 20.

The button panel 22 is mounted to the housing 12 below a level of the display 16 and is disposed at such a height that the average seated player's forearms are roughly horizontal. To minimize physical discomfort when operating a keyboard, ergonomic research indicates that the keyboard should be placed at approximately seated elbow height. A person's fingers should fall on the "home" row of keys while the person's arms fall straight down from the shoulders and the forearms are held parallel to the floor. In other words, the arms should rest at the person's sides, with the forearms held at approximately a 90 degree angle from the upper arms.

Because the seat of the stool 36 is approximately 24 inches above the floor 38, a middle portion of the button panel 22 is disposed at a height $H_1$ ranging from about 30 inches to about 35 inches above the floor 38. Such a height allows the average seated player 34 to keep his or her forearms roughly horizontal and at about a 90 degree angle from the upper arms. More preferably, the middle portion of the button panel 22 is disposed at a height $H_1$ ranging from about 32 inches to about 34 inches above the floor 38. The range of 32 to 34 inches represents the approximate variance in elbow height between a 97.5 percentile seated man and a 2.5 percentile seated woman. Most preferably, the middle portion of the button panel 22 is disposed at a height $H_1$ of 33 inches above the floor 38.

To allow the player 34 to easily reach the buttons on the button panel 22 from a neutral middle position, the button panel 22 is tilted toward the player 34. Specifically, the button panel 22 is angled slightly downward relative to the horizontal at an angle $\alpha$ ranging from about 5 degrees to about 25 degrees and, most preferably, about 15 degrees. In other words, a rear end of the button panel 22 is slightly higher than a front end of the button panel 22.

To provide the player 34 with adequate knee clearance as the player 34 operates the button panel 22, the middle portion of the button panel 22 is located closer to the seated player 34 than a front end of the coin tray 25. Specifically, a horizontal distance D between the middle portion the button panel 22 and the front end of the coin tray 25 (excluding any central spout on the front end of the coin tray) preferably ranges from about 1 inch to about 2.5 inches and is, most preferably, about 1.5 inches. The above distance D ensures that there is adequate knee clearance for the 97.5 percentile seated man. Because the knees of the 97.5 percentile seated man come closer to the gaming machine 10 than the knees of most of the population, most players are provided with adequate knee clearance.

With respect to the vertical location of the display 16, ergonomic research indicates that the top of the display 16 should be at about eye level or not more than 15 degrees below eye level. The approximately eye-level display 16 allows the head and neck of the player 34 to assume a posture that is both visually and posturally comfortable and allows the eyes of the player 34 to assume a comfortable gaze angle. When the display 16 is positioned at about the eye level of the average seated player 34, the display 16 is disposed at a height $H_2$ ranging from about 50.8 inches to about 57.6 inches above the floor 38 and, most preferably, from about 52 inches (for a 17 inch display) to about 54 inches (for a 19 inch display). The range of 50.8 to 57.6 inches represents the approximate variance in eye level between a 97.5 percentile seated man and a 2.5 percentile seated woman.

With respect to the angle of the display 16, ergonomic research indicates that the display 16 should be tilted back so that the top of the display, is slightly farther away from the eyes than the bottom and the center of the display is generally perpendicular to the seated player's line of sight. When people look at the world, objects in the upper part of the peripheral vision are generally farther away than the point people are looking at, and objects in the lower part of the peripheral vision are usually closer. As a result, the visual system has developed to perform best when the visual plane tilts away from people at the top. Tilting a monitor down, as is sometimes done to avoid glare, is opposite of the demonstrated capabilities of the visual system. The display 16 is tilted back from the vertical at an angle 0 ranging from about 5 degrees to about 20 degrees and, most preferably, from about 10 degrees to about 15 degrees. The angle $\beta$ is measured at the center of the display 16. If the housing 12 is designed to hold differently sized displays, the angle $\beta$ may be slightly different depending upon the size of the display.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. An upright gaming machine adapted to be played by a seated player, comprising:

a housing having a bottom end adapted to rest on a floor;

a display mounted to the housing;

a controller disposed within the housing; and a button panel mounted to the housing below a level of the display, the button panel including a middle portion disposed at a height ranging from about 30 inches to about 35 inches above the floor, wherein a forearm of an average seated player is substantially horizontal to the floor and substantially perpendicular to an adjoined upper arm of the player as the player operates the button panel with a hand adjoined to the forearm;

wherein in response to the player selecting a wager using the button panel, the controller is adapted to play a game of chance and randomly generate a game outcome on the display and provide a payout if the game outcome matches predetermined criteria.

2. The gaming machine of claim 1, wherein the display includes a window with physical slot reels visible therethrough.

3. The gaming machine of claim 1, wherein the display includes a video screen.

4. The gaming machine of claim 1, wherein the display is disposed at a height ranging from about 50 inches to about 58 inches above the floor.

5. The gaming machine of claim 4, wherein the display is disposed at a height ranging from about 52 inches to about 54 inches above the floor.

6. The gaming machine of claim 1, wherein the display is tilted back from a vertical direction at an angle β ranging from about 5 degrees to about 20 degrees so that a top of the display is farther away from eyes of the seated player than a bottom of the display, the angle β being measured at a center of the display.

7. The gaming machine of claim 1, wherein the housing includes a primary portion and a secondary portion, the primary portion being disposed above the secondary portion.

8. The gaming machine of claim 1, wherein in the game of chance the controller is adapted to cause the display to show video images of symbol-bearing reels in visual association with one or more pay lines, and wherein the button panel includes a plurality of buttons that, in response to being pressed by the seated player, cause the controller to perform respective game functions, the plurality of buttons including a first button for activating one or more of the pay lines, a second button for making the wager, a third button for initiating play of the game of chance, and a fourth button for collecting the payout.

9. The gaming machine of claim 1, wherein the button panel is tilted toward the player such that the button panel is angled downward relative to a horizontal direction at an angle a ranging from about 5 degrees to about 25 degrees.

10. The gaming machine of claim 1, further including a coin tray for dispensing the payout and mounted to the housing below a level of the button panel, the middle portion of the button panel being located closer to the player than a front end of the coin tray, excluding any central spout along the front end of the coin tray.

11. The gaming machine of claim 10, wherein a horizontal distance between the middle portion of the button panel and the front end of the coin tray ranges from about 1 inch to about 2.5 inches, excluding any central spout along the front end of the coin tray when determining the horizontal distance.

12. The gaming machine of claim 1, further including a player interface section arranged on the housing below a level of the display and above a level of the button panel, the player interface section including a card reader for receiving a player-tracking card of the player.

13. An upright gaming machine adapted to be played by a seated player, comprising:

a housing having a bottom end adapted to rest on a floor;

a display mounted to the housing;

a controller disposed within the housing;

a button panel mounted to the housing below a level of the display, the button panel including a middle portion disposed at a height ranging from about 30 inches to about 35 inches above the floor, wherein a forearm of an average seated player is substantially horizontal to the floor and substantially perpendicular to an adjoined upper arm of the player as the player operates the button panel with a hand adjoined to the forearm wherein in response to the player selecting a wager using the button panel, the controller is adapted to play a game of chance and randomly generate a game outcome on the display and provide a payout if the game outcome matches predetermined criteria; and a coin tray for dispensing the payout and mounted to the housing below a level of the button panel, the middle portion of the button panel being located closer to the player than a front end of the coin tray, excluding any central spout along the front end of the coin tray.

14. The gaming machine of claim 13, wherein a horizontal distance between the front end of the button panel and the front end of the coin tray ranges from about 1 inch to about 2.5 inches, excluding any central spout along the front end of the coin tray when determining the horizontal distance.

15. The gaming machine of claim 13, further including a player interface section arranged on the housing below a level of the display and above a level of the button panel, the player interface section including a card reader for receiving a player-tracking card of the player.

16. The gaming machine of claim 13, wherein the display is disposed at a height ranging from about 50 inches to about 58 inches above the floor.

* * * * *

UNITED STATES PATENT AND TRADEMARK OFFICE

CERTIFICATE OF CORRECTION

PATENT NO. : 6,334,612 B1
DATED : January 1, 2002
INVENTOR(S) : Wurz et al.

It is certified that error appears in the above-identified patent and that said Letters Patent is hereby corrected as shown below:

Title page,
Item [56], OTHER PUBLICATIONS, fourth reference, delete "(1994)" and insert -- (1974) --

Column 7,
Line 32, delete "a" and insert -- α --

Signed and Sealed this

Fourteenth Day of May, 2002

*Attest:*

*Attesting Officer*

JAMES E. ROGAN
*Director of the United States Patent and Trademark Office*